US006193476B1

(12) United States Patent
Sweeney

(10) Patent No.: US 6,193,476 B1
(45) Date of Patent: Feb. 27, 2001

(54) 1½ PISTON FORCE PUMP

(76) Inventor: Gerald T. Sweeney, 1411 Meridian East, Edgewood, Pierce County, WA (US) 98511-1057

( * ) Notice: Subject to any disclaimer, the term of this patent is extended or adjusted under 35 U.S.C. 154(b) by 0 days.

(21) Appl. No.: 09/394,985

(22) Filed: Sep. 13, 1999

(51) Int. Cl.[7] ..... F04B 17/00; F04B 9/08; F04B 39/10; F04F 11/00

(52) U.S. Cl. ..... 417/401; 417/383; 417/393; 417/92; 417/545

(58) Field of Search ..... 417/401, 378, 417/383, 393, 92, 545; 60/537

(56) References Cited

U.S. PATENT DOCUMENTS

| | | | | |
|---|---|---|---|---|
| 1,532,231 | | 4/1925 | Corey et al. | 417/378 |
| 2,014,613 | | 9/1935 | Ceverha | 417/383 |
| 2,174,114 | * | 9/1939 | Will | 417/378 |
| 2,376,538 | * | 5/1945 | Hardey | 417/383 |
| 2,490,118 | * | 12/1949 | Dickinson | 417/383 |
| 4,421,463 | * | 12/1983 | Lee | 417/383 |
| 4,551,075 | | 11/1985 | Canalizo | 417/383 |
| 5,118,517 | * | 6/1992 | Koster | 417/393 |
| 5,188,517 | | 2/1993 | Koster | 417/383 |
| 5,337,565 | * | 8/1994 | Meixner | 60/594 |

* cited by examiner

*Primary Examiner*—Timothy S. Thorpe
*Assistant Examiner*—Michael K. Gray
(74) *Attorney, Agent, or Firm*—James F. Leggett

(57) ABSTRACT

A deep well fluid pump which enables the pumping of fluid with much less energy which includes a power column of fluid of sufficient volume, which communicates to the under side of the lifting piston for the column of fluid to be lifted, but is isolated from said fluid to be lifted, to balance the head force of the column of fluid to be lifted, a pump means to increase the head force on the power column of fluid a sufficient amount to overcome the seal friction and pre-load spring down force of the lifting piston, so that it raises the lifting piston and thus discharges a volume of lifted fluid in a surface reservoir, and when the increase force on the power column of fluid is relieved, the pre-load spring forces the lifting piston down to reload.

19 Claims, 7 Drawing Sheets

1½ PISTON FORCE PUMP

BACKGROUND OF THE INVENTION

This invention relates generally to an improved mechanism and method for pumping fluid, with its primary application to raising subterranean fluid to the surface, at a substantial reduction in the energy required to do so, by means of combining a stroke piston chamber, containing a sufficient volume of fluid, completely isolated from the subterranean fluid but communicating with the under surface of the pump piston top, so that its head pressure is equal to the head pressure in the fluid out-put chamber, which results in the force (Psi) exerted upon the upper surface of the pump piston top being equal to the force (Psi) exerted upward upon the under surface of the pump piston top, while the pump piston base is totally isolated from the stroke piston chamber fluid by a pressure barrier, having a linear pre-load spring, of sufficient elasticity to overcome the seal friction and positively move the pump piston base to the bottom of its stroke, spanning the distance from it to the top surface of the pump piston base.

This invention is an improvement over my invention which is the subject of U.S. Pat. No. 4,834,620, issued May 30, 1989, and is applicable to much deeper wells.

It is known that the rigid drive components of pumps can be replaced with columns of fluid. See W. G. Corey U.S. Pat. No. 1,532,231, J. J. Ceverha U.S. Pat. No. 2,014,613, R. H. Dickinson U.S. Pat. No. 2,490,118 and C. H. Koster U.S. Pat. No. 5,188,517. It is also known that the force exerted by a column of fluid, subject to gravity or some other accelerator, or the hydrostatic head can be balanced by the force of another column of fluid subject to an accelerator. See J. J. Ceverha U.S. Pat. No. 2,014,613, R. J. Hardy U.S. Pat. No. 2,376,538, B. Lee U.S. Pat. No. 4,421,463, and C. R. Canalizo U.S. Pat. No. 4,551,075.

The pumps having balanced columns of fluid either have required energy to lift the hydrostatic head on each direction of the stroke, i.e. W. G. Corey U.S. Pat. No. 1,532,231 and B. Lee U.S. Pat. No. 4,421,463 or have two faces of the pumping mechanism which each lift the hydrostatic head in the same direction, i.e. J. J. Ceverha U.S. Pat. No. 2,014,613 and C. R. Canalizo U.S. Pat. No. 4,551,075. Further limitations of the prior art include too great a force being applied to the pump components when the pressure on the power fluid column is released and their travel is mechanically stopped, lack of isolation of the power fluid from the production fluid, and the inability to easily add additional fluid to the power fluid column.

It is an object of this invention to provide a single stroke pump which can move a column of fluid against an hydrostatic head a variable distance, using significantly less energy that the prior art due to moving the hydrostatic head only once and only the distance of the stroke of the single stroke power piston.

It is a further object of this invention to provide an hydraulic pump as in the preceding object wherein the reduction in hydrostatic head, from fluid ejected from the column of production fluid by the movement of the pump, and the resistance of seals and friction are over come by a pre-load linear spring which returns the pump to its position of rest when the stroke piston returns to its starting position.

Another object is to provide an hydraulic pump according to the preceding object wherein there is provision for a replenishment valve in the power piston to replace any fluid inadvertently or intentionally by-passing the high pressure seals.

Another object of this invention is to provide a single stroke hydraulic pump, wherein the stroke piston is powered in one direction only and at the completion of the single stroke all power is removed from the piston so it is free to return to the starting position, with the columns of production and power fluid being so balanced that the at rest, starting, position of the stroke piston is at a point at which the power column is balanced to the production column, thus the production piston is moved into the recharge position only by the force of the pre-load spring and not the entire hydraulic head of the production column, resulting in minimal stress upon the stop of the production piston when it reached the limit of its travel.

A further object of this invention is to provide a single stroke hydraulic pump as in the preceding object wherein the fluid in the power column is completely isolated from the production fluid so that its density may be varied or the shape of the power column may be varied so long as the total force upon the side of the production piston opposite to the production fluid, remains the same.

A further object of this invention is to provide a method of using a pressurized volume of fluid to balance and equally off-set the static pressure exerted opposing the movement of a volume of fluid by a piston, wherein the volume of fluid to be moved will be reduced in volume by the movement, which volume will be replaced from ambient fluid when the piston is moved in the opposite direction by a pre-charge means, wherein the pre-charge means and the pressurized volume of fluid to balance and equally off-set are isolated from the volume of fluid to be moved.

Other objects, features and advantages of the invention will be apparent from the drawings, the specification and the claims.

SUMMARY OF INVENTION

This invention satisfies these objects in that it is comprised of an apparatus having a column of power fluid, restrained between a single action stroke piston and the bottom surface of the top piston of a pump piston, said column of power fluid having a static head pressure equal to the static head pressure of the column of production fluid restrained by the top surface of the top of the pump piston and completely isolated from said production fluid, both by the seals between the sides of the top piston of the pump piston and the sides of the production fluid column chamber and a pressure barrier isolating the column of power fluid from the pump piston base and the production fluid, and having a linear pre-charge spring communicating between the bottom surface of the pressure barrier and the top surface of the pump piston base so that when it is at rest the pump piston is fully charged with production fluid, which enters the pump piston through an entry tube in the well screen controlled by a ball check valve which opens when the external pressure of the production fluid exceeds the internal pressure of the production fluid in the pump piston and closes when the two pressures equalize. The pump piston has a fluid passage through its center running vertically from its base piston to its top piston, communicating with the column of production fluid above the top piston and the production fluid which enters the pump piston through the production fluid entry tube, and having a ball check valve at the end passing through the bottom piston which closes against the narrowed sides of the passage in the bottom piston when the pressure in the production fluid passage exceeds the pressure in the area of the well screen, which occurs when pump piston and production fluid column is moved by the increase in pressure of the column of power fluid against the bottom surface of the top piston of the pump piston produced by the single stroke of the power piston acting upon the column of power fluid, thus raising the column of production fluid the stroke distance of the pump piston and discharging a quantity of production fluid at the end of the pump piston fluid output chamber in a reservoir. When the power piston completes its power stroke, the linear pre-load spring forces the pump piston base back to its position of rest, in that its is of sufficient force to overcome the imbalance in the two fluid columns resulting from the discharge of the quantity of production fluid from the production column and the internal friction of the apparatus.

The novel features of the invention will be best understood from the following description in light of the accompanying drawings. While particular embodiments of the present invention are shown and described, it will be obvious to those skilled in the art that changes and modifications may be made without departing from this invention in its broader aspects and, therefore, the aim of the appended claims is to cover all such changes and modifications as fall within the true spirit and scope of this invention.

DESCRIPTION OF THE PREFERRED EMBODIMENTS

Figure 1:
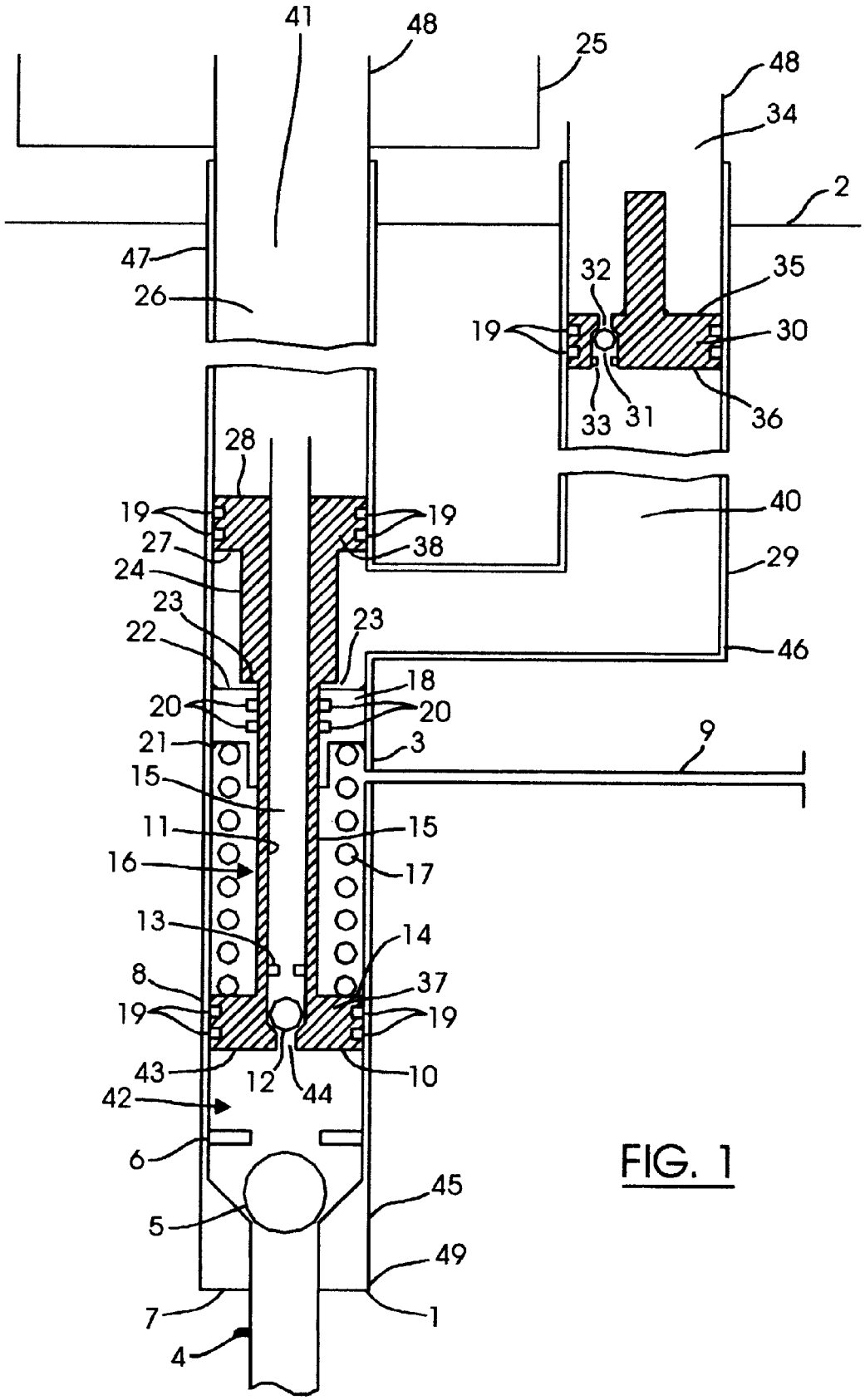
FIG. 1 is a schematic view in vertical cross section of the invention.

With reference to FIG. 1, the 1½ Piston Force Pump (1) is shown in its preferred embodiment, raising subterranean production fluid substantial distances from the natural production fluid level (3) to the surface (2) of the earth a waiting reservoir (25), with its components at the static neutral position, being comprised of a pump body (8) of standard rigid hollow tubular construction, comprised of a lower pump cylinder (45), a stroke tube (46) and a production tube (47), having a bottom end (49) and a surface end (48), with a well screen (7) of standard design at the bottom end of the lower pump cylinder (45), equipped with a production fluid entry tube (4) through which production fluid flows past a production fluid entry tube ball check valve (5) of a diameter greater than that of the production fluid entry tube and floatably restrained vertically by a production fluid entry tube ball check valve retainer (6), so that when the pressure of the fluid inside the production fluid entry chamber (42) equals the pressure outside the production fluid entry tube (4), the production fluid entry tube ball check valve will fall against and block the production fluid entry tube (4), and the end of the production fluid entry chamber (42) opposite to the production fluid entry tube ball check valve (5)communicates with the column of production fluid (41) through a production fluid passage (15), running vertically through the center of the pump piston (43), from its pump piston base (37) to its pump piston top (38), having a pump piston ball check valve (12), floatably located just above the narrow bottom outlet (44) of the fluid passage (15) within the pump piston base (37) and vertically restrained by a pump piston ball check valve retainer (13), which closes when the pressure within the production fluid entry chamber (42) equals the pressure in the fluid passage (15) within the pump piston (43). The arrangement of the ball check valve (5) and piston ball check valve (12) provides entering and preventing means for allowing external production fluid into the pump body and into the production fluid passage in the pump piston and preventing the fluid from flowing out when the pump piston is raised.

With further reference to FIGS. 1, 3, 4, and 5, the pump piston (43) is shown to be composed of a pump piston base (37), spanning the interior of the pump body (8) and movably communicating therewith by standard seal (19) means and having a bottom surface (10) and a top surface (14), a narrow walled portion (11) and a thick walled portion (24) of a fluid passage (15) and pump piston top (38), having an under surface (27) and an upper surface (28) and spanning the interior of the pump body (8) and movably communicating therewith by standard seal (19) means. A pressure barrier (18), comprised of a collar of impervious, rigid material, extends inward from the pump body (8), at a point along the vertical span of the pump body (8), by which the lower pump cylinder (45) is separated from the stroke tube (46) and the production tube (47), below the stroke piston chamber (29), to completely occupy the space between the inner surface of the pump body (8) and the outer surface of the narrow walled portion (11) of the production fluid passage (15) through the pump piston (43) while allowing the vertical movement of the narrow walled portion (11) of the fluid passage, but preventing the passage of any fluid outside of the pump piston (43) by high pressure seal means (20). The thick walled portion (24) of the production fluid passage (15) within the pump piston top (38) flares perpendicularly from the narrow walled portion (11), thus forming shoulder stops (23) which limit the movement of the pump piston top (38) when the shoulder stops (23) impact the top surface (22) of the pressure barrier (18) and extends a sufficient vertical distance from the pressure barrier (18) to span the stroke piston chamber (29), so that the stroke of the pump piston (43) is limited so that the pump piston top (38) cannot physically descend to a point where the seal between the stroke piston chamber (29) and the pump piston fluid output chamber (26) is compromised.

Figure 6:
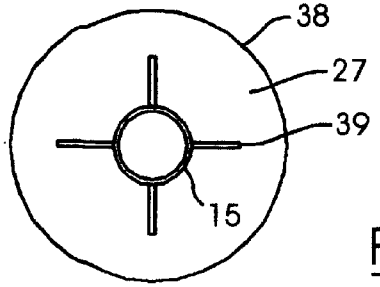
FIG. 6 is an aspect view of the bottom surface of the top piston of the pump piston.

With reference to FIG. 6, an alternative form of the thick walled portion (24) of the fluid passage (15) through the pump piston top (38) is disclosed wherein piston stop vanes (39) are spaced evenly around the exterior circumference of the production fluid passage adjacent to the under surface (27) of the pump piston top (38) and are of sufficient length to span the distance from the top surface (22) of the pressure barrier (18) to the portion of the pump body (8) above the stroke piston chamber (29).

Returning to FIGS. 1, 3, 4, and 5 a pre-load linear spring (17), i.e., resetting means, having sufficient force to overcome the differential in static hydraulic head pressure, between the column of power fluid, when the single stroke of the stroke piston (30) is exhausted, and the column of production fluid, reduced by the amount discharged into the reservoir (25) when the pump piston (43) reaches the top limit of its travel, plus the system friction, so that it forces the pump piston base (37) down to the start position (See FIG. 5), which pre-load linear spring stretches from the bottom surface (21) of the pressure barrier (18) to the top surface (14) of the pump piston base (37) in the space between the inner surface of the pump body (8) and the outer surface of the narrow walled portion (11) of the production fluid passage (15) in the pump piston (38), and is compressed when the single stroke piston (30), i.e., powering means, having an upper surface (35) and a lower surface (36), which spans the interior of the stroke tube (46) and movably communicating therewith by standard seal means (19), thus establishing an upper limit for the column of power fluid (40) within the stroke piston chamber (29) which communicates to the under surface (27) of the pump piston top (38) and is of sufficient volume so that its static hydraulic head pressure, when the stroke piston (30) is unpowered, is identical to the static hydraulic head pressure of the column of production fluid (41) when the pump piston (38) is fully extended in the downward direction (See FIG. 3), is driven, by standard power means, against the column of power fluid (40) so that the head pressure of the column of power fluid (40) exceeds the static hydraulic head pressure of the column of production fluid (41) with the result that the pump piston (38) is forced up, reducing the pressure in the production fluid entry chamber (42) and closing the pump piston ball check valve (12) and opening the fluid entry tube ball check valve (5), while at the same time lifting the column of production fluid (41) until the pre-load linear spring (17) is fully compressed and discharging the production fluid from the top of the column of production fluid (41) into the reservoir (25) (See FIG. 5). The stroke piston (30) has a replenishing passage (32) between the upper surface (35) and the lower surface (36) with the passage narrowing at the upper surface (35) to a diameter less than the diameter of a replenishing ball check valve (31), floatably maintained within the replenishment passage (32) by a replenishment ball check valve retainer (33), so that power fluid from the fluid chamber (34) above the stroke piston (30) can flow to recharge the column of power fluid (40) should any by-pass the high pressure seals (20) in the pressure barrier (18). The area between the pump piston base (37) and the pressure barrier (18) outside of the narrow walled portion (11) of the production fluid passage (15) within the pump piston (43) and the pump body (8) has a vent (9), to outside the pump body (8), located below the top of the production fluid level (3) outside the pump body (8).

Figure 2:
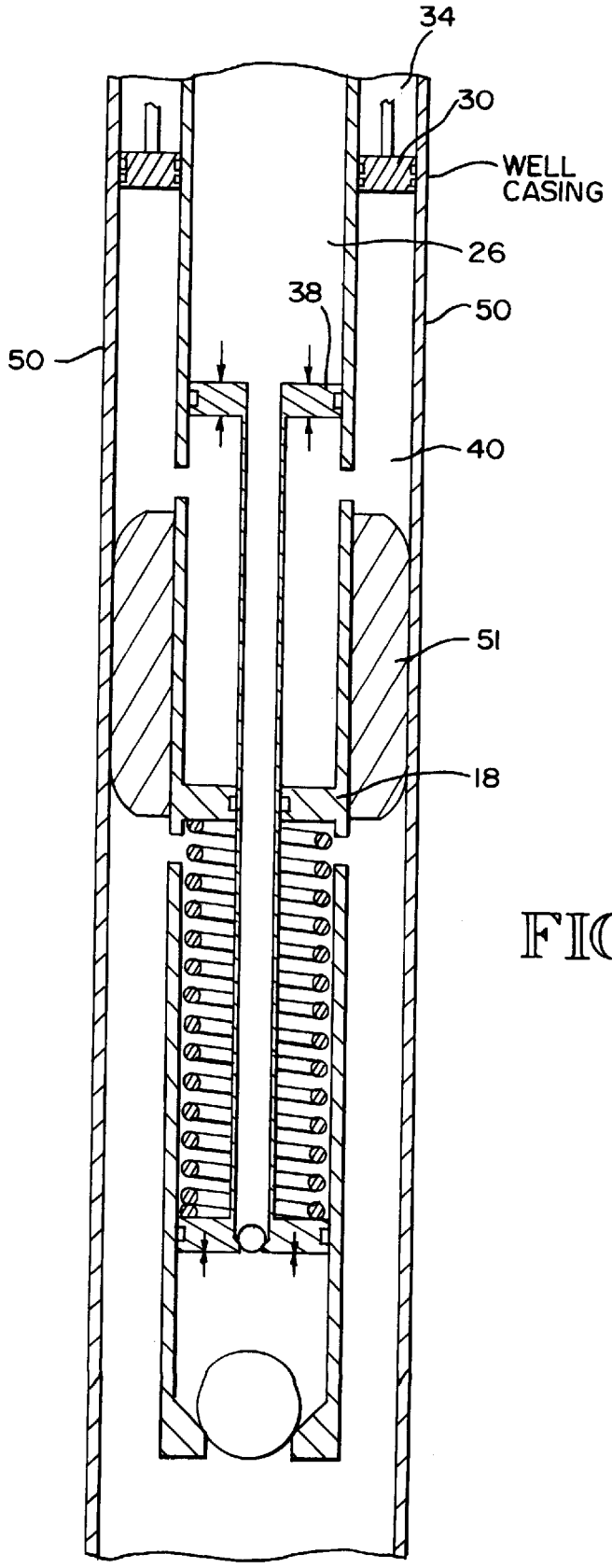
FIG. 2 is a schematic view in vertical cross section of an alternative form of the invention within a well casing.
Figure 3:
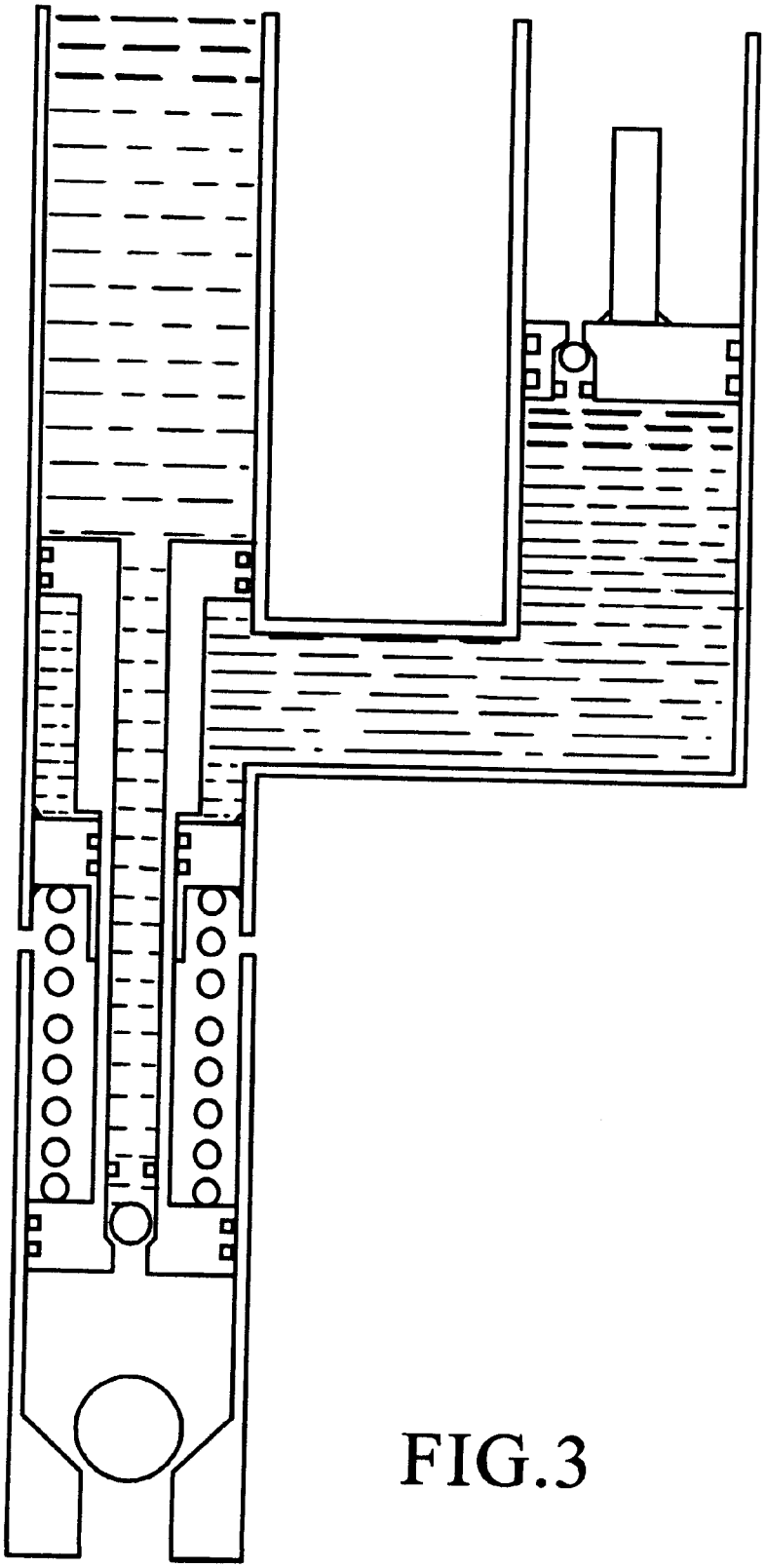
FIG. 3 is a schematic illustration of the invention at the neutral, static position.
Figure 4:
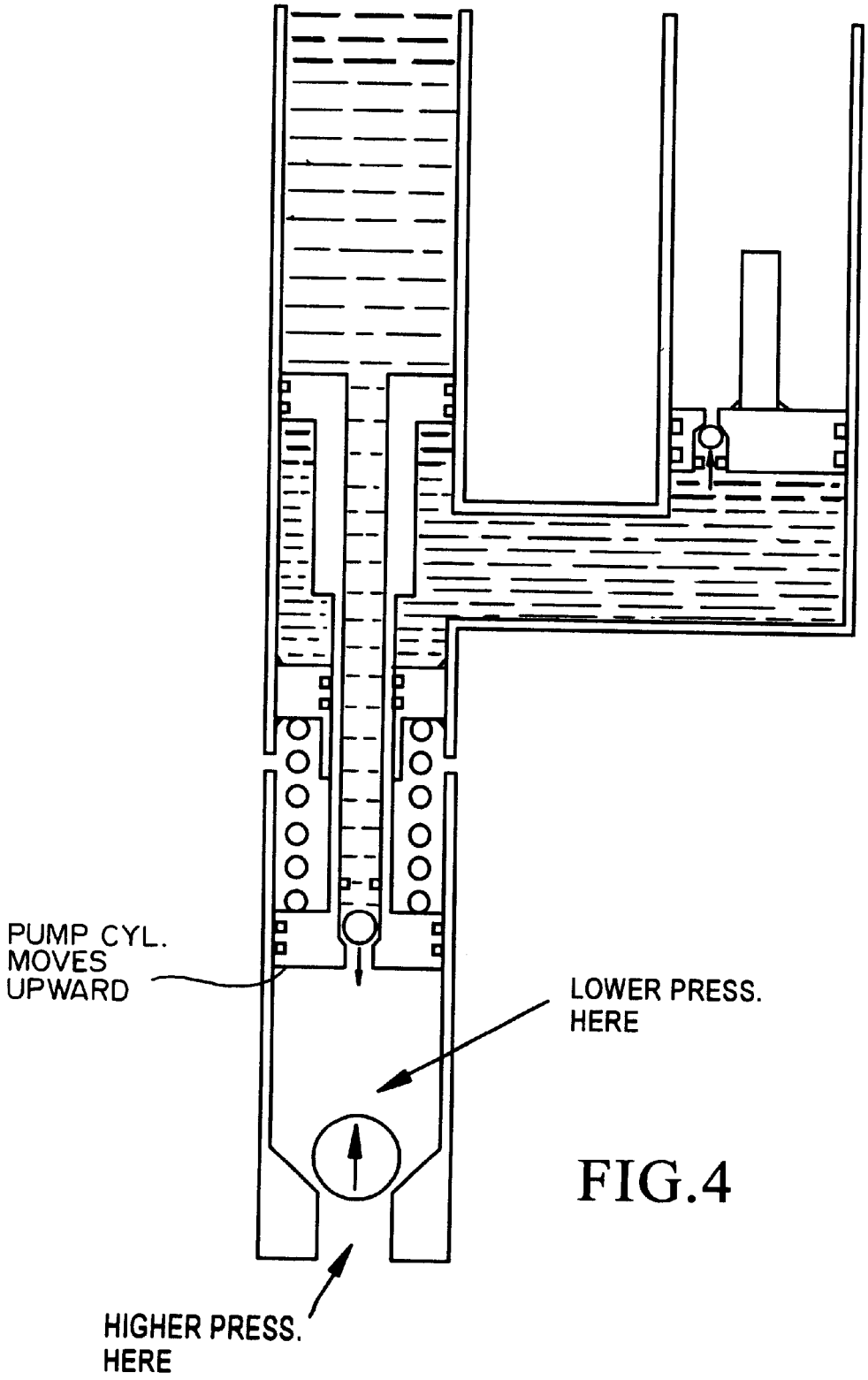
FIG. 4 is a schematic illustration of the invention during the stroke of the power piston.
Figure 5:
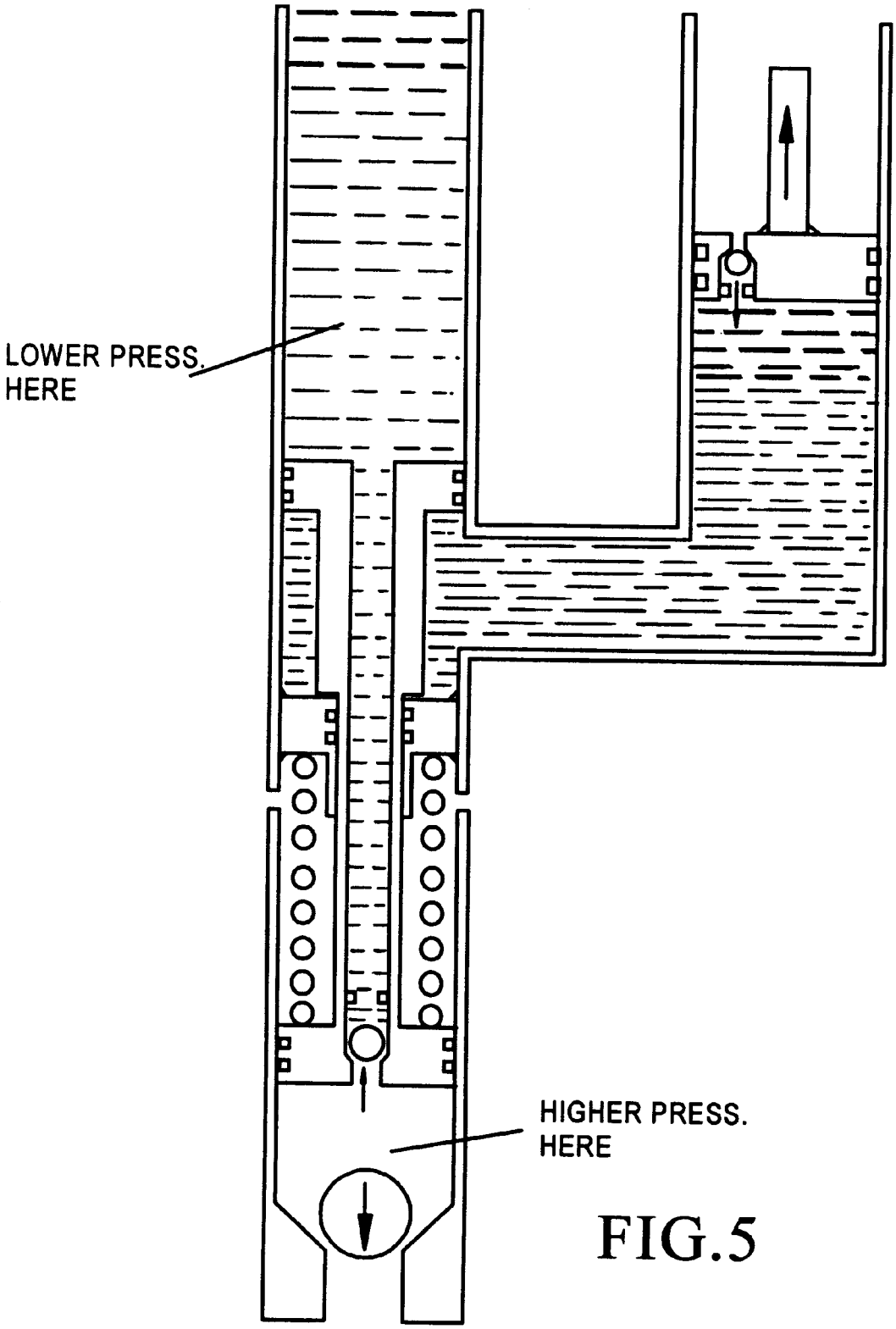
FIG. 5 is a schematic illustration of the invention during the reload phase as the pre-load spring moves the pump piston to the neutral position.

With reference to FIG. 2, an alternative arrangement of the components of the invention is shown, said alternative arrangement being comprised of inserting the components of the 1½ piston force pump within a common well casing (50), the production fluid (3) separated from the power fluid (40) by means of a packer (51), with the portion of the pump piston (43) and pump piston fluid output chamber (26) above the pressure barrier (18) is placed inside of the column of power fluid (40), stroke piston (30) and the fluid chamber (34) above the stroke piston (30).

Figure 7:
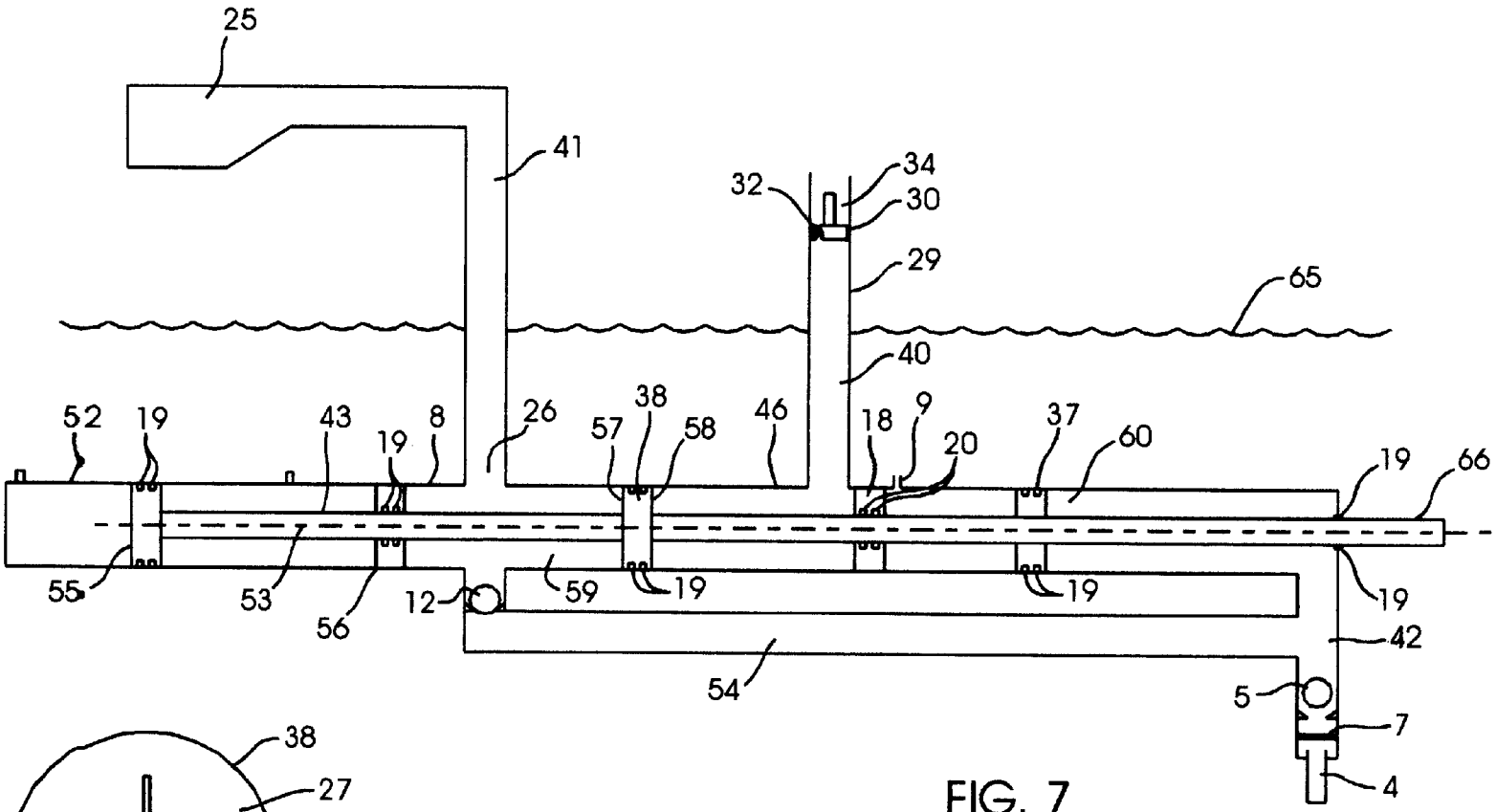
FIG. 7 is a schematic view in vertical cross section of another alternative form of the invention in horizontal installation.

With reference to FIG. 7, an alternative arrangement of the components of the invention is shown in horizontal installation wherein the preload linear spring function of linear spring (17) of the embodiment demonstrated in FIG. 1 is replaced by an hydraulic pre-charge cylinder (52) and the production fluid passage (15) within the pump piston is replaced by a solid shaft (53). Shaft (53) connects the hydraulic pre-charge cylinder (52) to the pump piston top (38). Pump piston top (38) is positioned in the discharge end (59) of the pump body (8) whereas pump piston base (37) is positioned in the pumping end (60) of the pump body (8).

The piston pump (43) comprises the shaft (53), pump piston top (38) and pump piston base (37), with pump piston top (38) and pump piston base (37) being connected by shaft (53). A pressure barrier (18), provided with sealing means (20), is positioned between pump piston top (38) and pump piston base (37). The sealing means (20) allow the shaft to slide therebetween while preventing fluid from passing from one side of the pressure barrier (18) to the other. Pump piston top (38) and pump piston base (37) are provided with sealing means (19) which contact the interior wall of the pump body. Pump piston top (38), pump piston base (37), the sealing means (19) of pump piston top (38) and pump piston (37), and pressure barrier (28) and pressure seal (20) can be considered as isolating means for isolating power fluid from the production fluid.

Still with reference to FIG. 7, the horizontally-oriented components in the pump body (8) are positioned below the fluid production level (3). The production fluid entry chamber (42) communicates directly to the pump piston fluid output chamber (26) through the supply tube (54) and through the piston ball check valve (12).

The hydraulic pre-charge cylinder (52), formed at the end of the pump body (8) opposite to the production fluid entry chamber (42), being bounded on one end by a pre-charge plate (55) which slidably communicates with the interior surface of the hydraulic pre-charge cylinder (52) by seal means (19) so that the pressure within the hydraulic pre-charge cylinder (52) varies with the movement of the pre-charge plate (55), thus fulfilling the same function as the pre-load linear spring (17) in the embodiment of the invention shown in FIG. 1.

The pump piston (43) is comprised a pump piston top (38), a pump piston base (37) and a solid shaft (53). The pump piston (43) slidably communicates with the inner surface of the pump body by sealing means (19). The solid shaft (53) is connected to a pre-charge plate (55) at one end of the pump body (8). The pre-charge plate (55) slidably communicates with the interior surface of the pump body by sealing means (19) attached to the radial periphery of the pre-charge plate (55). Movement of the pump piston's solid shaft (53) changes the pressure in the hydraulic pre-charge cylinder (52). The solid shaft (53) extends perpendicularly from the pre-charge plate (55) to slidably penetrate an end barrier (56) provided with sealing means (19). The solid shaft (53) extends through production fluid output chamber (26) whose length is limited by the discharge face (57) of the pump piston top (38) and by the end barrier (56). The solid shaft (53) extends through stroke tube (46) of the pump body (8) and through pressure barrier (18). The pressure barrier (18) is provided with high pressure sealing means (20) which prevents the power fluid from mixing with production fluid in cooperation with sealing means (19) of the pump piston base (37) and the pump piston top (38). Between the pump piston base (37) and pressure barrier (18) is a vent (9) leading to outside the pump body (8) at a location below the ambient fluid production level (3) so as to eliminate cavitation. Movement of the piston base (37) in a direction opposite to the hydraulic precharge cylinder (52) increases the pressure in the production fluid entry chamber (42) thereby closing the ball check valve (5) of the production fluid entry tube (4) and opening the pump piston ball check valve (12) to fill the pump piston fluid output chamber (26) and the column of production fluid (41) with production fluid through a supply tube (54) from the production fluid entry chamber (42).

The movement of the pump piston base (37) toward the hydraulic pre-charge cylinder (52) is mechanically limited by the pressure barrier (18), and said movement reduces the pressure in the production fluid entry chamber (42) which opens the production fluid entry tube ball check valve (5) and closes the pump piston ball check valve (12) so that production fluid is allowed to fill the supply tube (54) and the production fluid entry chamber (42). The pressure barrier is a collar of impervious rigid material which extends inward from the exterior well casing (8) at a point along the horizontal span of the pump body (8) to isolate the power fluid within the stroke tube (46) from the production fluid within the production fluid entry chamber (42). The pump piston top (38) is so located along the length of the solid shaft (53) so that it does not reach the stroke piston chamber (29) when the pump piston (43) is fully extended toward the production fluid entry chamber (42) and does not reach the pump piston production fluid output chamber (26) when the pump piston (43) is fully extended in the opposite direction.

In the embodiment of the invention shown in FIG. 7, the powering means is also a single stroke piston (30), having an upper surface (35) and a lower surface (36) and spans the interior of the stroke piston chamber (29) and movably communicates therewith by sealing means (19), which establishes the upper limit for a column of power fluid (40) which communicates to the pumping face (58) of the pump piston top (38), and said single stroke piston (30) is driven against the column of power fluid (40), so that the pressure within the column of power fluid (40) exceeds the static pressure of the column of production fluid (41) plus system friction and the preload force in the hydraulic pre-charge cylinder (52), with the result that the pump piston (43) moves toward the hydraulic pre-charge cylinder (52), lifting the column of production fluid (41) and discharging a portion of the production fluid from the top of the column of production fluid (41) into a reservoir (25). When the drive force is exhausted from the stroke piston (30), the pump piston (43) is reset because the pressure within the hydraulic pre-charge cylinder (52) is sufficient to overcome the differential in static pressure, between the column of power fluid (40), when the single stroke of the stroke piston (30) is exhausted, and the column of production fluid (41), reduced by the amount discharged into the reservoir (25), when the pump piston (43) reached the limit of its travel in the discharge direction toward the hydraulic pre-charge cylinder, plus the system friction, so that the pre-charge plate (55) and the solid shaft (53) to which it is attached is forced toward the production fluid entry chamber (42), which raises the pressure in said chamber (42) which closes the production fluid entry tube ball check valve (5) and opens the pump piston ball check valve (12) to refill the pump piston production fluid output chamber (26) and column of production fluid (41). A volume balancing extension (66) of the solid shaft (53), which extends from the pumping end (60) through the production fluid entry chamber (42) via seal (19) means, may be utilized to reduce the volume of the production fluid chamber (42) so the volume of production fluid passing into the production fluid output chamber (26) remains in balance.

The single stroke piston (30) utilized in the embodiment of the invention shown in FIG. 7 utilizes the same stroke piston (30) as shown in the embodiment in FIG. 1, in that it has a replenishment passage (32) between the upper surface (35) and the lower surface (36) with the passage narrowing at the upper surface (35) to a diameter less than the diameter of a replenishment ball check valve (31), floatably maintained within the replenishment passage (32) by a replenishment ball check valve retainer (33), so that power fluid from a fluid chamber (34) in the stroke piston chamber (29) above the stroke piston (30) can flow to recharge the column of power fluid (40) should any by-pass the high pressure seals (20) in the pressure barrier (18).

Figure 8:
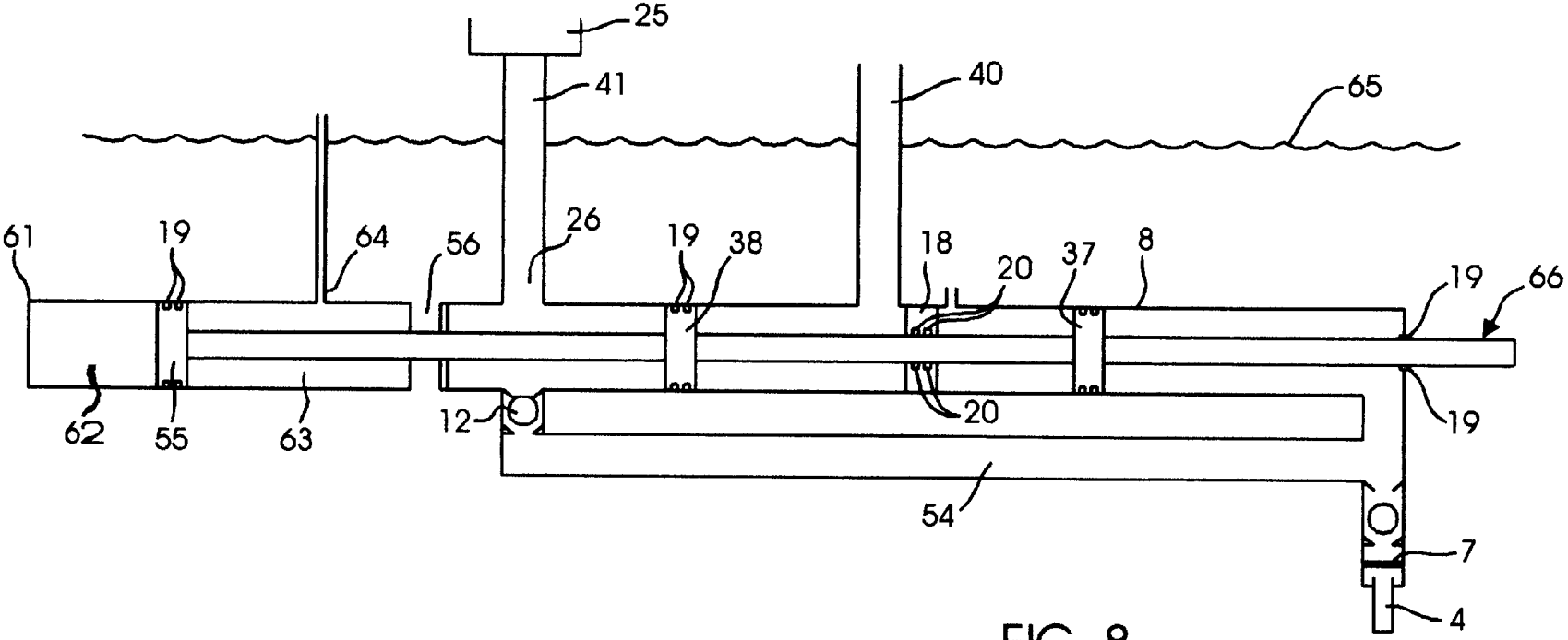
FIG. 8 is a schematic view in vertical cross section of an alternative of the form of the invention shown in FIG. 7.

With reference to FIG. 8, an alternative of the form of the invention shown in FIG. 7 is disclosed wherein the single stroke piston (30) is removed from the column of power fluid (40) and the hydraulic precharge cylinder (52) is converted to an hydraulic power cylinder (61) having a pre-charge side (62), of sufficient force to overcome the difference in the force of the column of power fluid (40) plus internal friction, so that it moves the precharge plate (55) and the solid shaft (53) and the pump piston top (38) and pumping end (60) toward the production fluid entry chamber (42) thereby opening the pump piston ball check valve (12) when the volume of the column of production fluid (41) is reduced by discharging into the reservoir (25) much like the pre-load linear spring (17) does in the embodiment of the invention shown in FIG. 1.

In addition, the power side (63) of the hydraulic power cylinder (61), opposite to the precharge side (62), receives the power from a remote drive means (64) of sufficient force to move the precharge plate (55) to compress the precharge in the precharge side (62), thereby moving the solid shaft (53) and discharge face (57) to close the pump piston ball check valve (12) and force production fluid from the column of production fluid (41) into the reservoir (25).

The form of the invention shown in FIG. 8 and described above is particularly suited for pumping water from a body of water up to an higher elevation wherein the horizontal installation is below the ambient production fluid level (3), i.e. the surface (65) of the body of water, and the column of production fluid (41) extends to the higher elevation by standard pipe means where the reservoir (25) is located. The volume of power fluid within the column of power fluid (40), also encased in standard pipe means, is the volume whose static pressure on the pumping face (58) equals the static pressure on the discharge face (57), when the column of production fluid (41) is filled to capacity, plus system friction. Thus, minimal power need be applied to the precharge plate (55) by the drive means (64) to discharge a volume of production fluid from the column of production fluid (41) into the reservoir (25) and to compress the precharge side (62) of the hydraulic power cylinder (61). The physical space or separation between cylinder (61) and pump body (8) represents an end barrier (56).

When the drive means (64) releases its force, the precharge side (62) of the hydraulic power cylinder (61) applies sufficient force to the precharge plate (55) to move the solid shaft (53) a sufficient distance to lower the pressure in the pump piston fluid output chamber (26) to unseat the pump piston ball check valve (12) and allow production fluid from the supply tube (54) to refill the column of production fluid (41). The pressure of the ambient production fluid upon the production fluid entry tube ball check valve (5) is determined by the distance the invention is below the production fluid level (3). Therefore, as the production fluid level (3) lowers, the volume of power fluid in the column of power fluid (40) will have to be increased proportionately to maintain the static balance within the invention. This is because the pressure of the ambient production fluid communicates through the two ball check valves (5) and (12) to add its force to that of the column of power fluid (40) to raise the column of production fluid (41).

It will be apparent to someone reasonably skilled in the art that the hydraulic power cylinder (61) and drive means (64)

could be replaced by a dual stroke hydraulic cylinder operated by suitable power means without losing the benefit of the reduction in power required by the static balance of the column of production fluid (41) and the column of power fluid (40), being isolated from each other throughout the pump cycle.

As can be seen from the foregoing preferred and alternative embodiments of this invention, there is a central principle applied which involves a new and improved method of using a pressurized volume of fluid to balance and equally off-set the static pressure exerted opposing the movement of a volume of fluid by a pump piston (43) wherein the volume of fluid to be moved will be reduced in volume by the movement, which volume will be replaced from ambient fluid when the piston is moved in the opposite direction by a pre-charge means, wherein the pre-charge means and the pressurized volume of the fluid to be balanced and equally offset are isolated from the volume of fluid to be moved.

The foregoing disclosure and description of the invention are illustrative and explanatory thereof and, it will be understood by those skilled in the art that various changes in the size, shape and materials, as well as in the details of the illustrated construction, may be made within the scope of the appended claims without departing from the scope or spirit of the invention.

I claim:

1. A single stroke hydraulic pump for raising production fluid against the force of gravity a substantial distance, comprising:

a pump body;

a pump piston having a top and a base connected by a production fluid passage with at least the base being below a natural production fluid level;

a column of production fluid, within the pump body, stretching from the base of the pump piston to a discharge reservoir, and having a static hydraulic head pressure;

a column of power fluid within the pump body and having hydraulic head pressure identical to the static hydraulic head pressure of the column of production fluid when at a maximum volume;

powering means isolated from the production fluid for powering the pump piston, and, as a result, raising the column of production fluid with the resultant discharge of a volume of production fluid into a discharge reservoir;

a pressure barrier to isolate the powering means from the production fluid and to restrain the stroke of the pump piston;

resetting means to return the pump piston to a start position, after a volume of the column of production fluid has been discharged to the reservoir at a controlled rate so as not to damage the pressure barrier or the pump piston;

entering and preventing means for allowing external production fluid to enter into the pump body and into the production fluid passage in the pump piston and preventing the production fluid from flowing out when the pump piston is raised; and wherein the static hydraulic head of the column of production fluid is raised only once the length of the stroke of the pump piston, and a volume of the production fluid is discharged from the top of the column of production fluid and the column of production fluid is returned without violent force to a point of beginning.

2. A pump according to claim 1, wherein the pump body has a surface and a bottom end, the pump body being of a rigid hollow tubular construction and below the pressure barrier is a single lower pump cylinder containing a production fluid entry chamber, and above the pressure barrier splits into a production tube containing a pump piston fluid output chamber and a stroke tube containing a stroke piston chamber.

3. A pump according to claim 1, wherein the entering and preventing means comprises a drill screen at the bottom end of the pump body equipped with a production fluid entry tube through which production fluid flows into a production fluid entry chamber past a production fluid entry tube ball check valve of a diameter greater than that of the production fluid entry tube and floatably restrained vertically by a production fluid entry tube ball check valve retainer, so that when the pressure of the fluid inside the production fluid entry chamber equals the pressure outside the production fluid entry tube, the production fluid entry ball check valve will fall against and block the production fluid entry tube, and the end of the production fluid entry chamber opposite to the production fluid entry tube ball check valve communicates with a column of production fluid through a production fluid passage in the pump piston.

4. A pump according to claim 1, wherein the pump piston has a pump piston base, spanning the interior of the pump body and movably communicating therewith by first sealing means and having a bottom surface and a top surface, a production fluid passage having a narrow walled portion adjacent to said base, with a narrow bottom outlet running vertically through the center of the pump piston from the pump piston base to the pump piston top, having an under surface and an upper surface, and spanning the interior of the production tube portion of the pump body and movably communicating therewith by pressure sealing means and having a pump piston ball check valve floatably located just above the narrow bottom outlet of the production fluid passage with the pump piston base and vertically restrained by a pump piston ball check valve retainer which closes when the pressure within the production fluid entry chamber equals the pressure in the production fluid passage in the pump piston with a thick walled portion of the production fluid passage being positioned above a pressure barrier.

5. A pump according to claim 1, wherein the pressure barrier comprises a collar of impervious rigid material extending inward from the pump body at a point along the vertical span of the pump body by which a lower pump cylinder is separated from a stroke tube and a production tube and below a stroke piston chamber so as to completely occupy a space between the inner surface of the lower pump cylinder portion of the pump body and the outer surface of the production fluid passage through the pump piston while allowing the vertical movement of a narrowed walled portion of the production fluid passage through the pump piston, but preventing the passage of any fluid outside of the pump piston by pressure sealing means, with perpendicular shoulder stops where a narrow walled portion abruptly transitions to a thick walled portion of the production fluid passage in the pump piston limiting the movement of the pump piston when the shoulder stops impact the top surface of the pressure barrier, with the thick walled portion of the production fluid passage in the pump piston extending a sufficient vertical distance from the pressure barrier to span the stroke piston chamber, so that the stroke of the pump piston is limited so that the pump piston top cannot physically descend to a point where the isolation between the stroke piston chamber and the pump piston fluid output chamber is compromised.

6. A pump according to claim 1, wherein:

said powering means comprises a single stroke piston spanning the interior of a stroke tube and communicating therewith by sealing means establishing the upper limit for a column of power fluid which communicates to the under surface of the pump piston top and is driven against the column of power fluid so that the head pressure of the column of power fluid exceeds the static hydraulic head pressure of the column of production fluid plus system friction and a pre-load force, with the result that the pump piston is forced up, reducing the pressure in the pump production fluid entry chamber and closing a pump piston ball check valve and opening a fluid entry tube ball check valve, while at the same time lifting the column of production fluid and discharging a portion of the production fluid from the top of the column of production fluid out the surface end of the pump body casing into the discharge reservoir.

7. A pump according to claim 6, wherein:

the resetting means comprises a preload linear spring of sufficient force to overcome the differential in static hydraulic head pressure between the column of power fluid when the single stroke of the stroke piston is exhausted and the column of production fluid, reduced by the amount discharged into the reservoir when the pump piston reaches a highest point, plus the system friction, forces the pump piston base down to the starting position, and stretches from the bottom surface of the pressure barrier to the top surface of the pump piston base, in the space between the inner surface of the pump body and the outer surface of the narrowed walled portion of the production fluid passage in the pump piston, which space has a vent to outside the pump body located below the top of the natural production fluid level outside the pump body and is compressed by the drive of the single stroke piston with the compressed length of the single stroke piston becoming the mechanical limit of the stroke of the stroke piston.

8. A pump according to claim 6, wherein the single stroke piston has a replenishing passage between the upper surface and the lower surface with the passage narrowing at the upper surface to a diameter less than the diameter of a replenishment ball check valve floatably maintained within the replenishment passage by a replenishment ball check valve retainer so that power fluid form a fluid chamber in the stroke tube above the stroke piston can flow to recharge the column of power fluid should any by-pass the pressure seals in the pressure barrier.

9. A pump according to claim 1, wherein:

the pump body and pump piston are installed within a common well casing with the production fluid being separated from the power fluid by a packer with the portion of the pump piston and a pump piston fluid output chamber above the pressure barrier being placed inside of the column power fluid; and wherein the powering means comprises a stroke piston with the stroke piston and a fluid chamber above the stroke piston and the pump piston fluid output chamber extending through the stroke piston and above the fluid chamber above the stroke piston to discharge into the reservoir.

10. A pump according to claim 3, wherein:

a thick wall portion of the production fluid passage is provided with piston stop vanes spaced evenly around the exterior circumference of the production fluid passage adjacent to the under surface of the pump piston top and are of sufficient length to span the distance from the top surface of the pressure barrier to the portion of the production tube above the stroke tube and stroke piston chamber.

11. A single stroke hydraulic pump for raising production fluid against the force of gravity a substantial distance, comprising:

a pump body having a discharge end and a pumping end;

a powering means;

a pump piston connected by a solid shaft within the pump body which is completely submerged in the production fluid except for a top of a column of production fluid and the powering means;

a column of production fluid within the pump body stretching from a pump fluid output chamber on the discharge end of the pump body to a discharge reservoir above the surface of the production fluid in which the pump piston is submerged and having a static hydraulic head pressure;

a column of power fluid within the pump body and having an hydraulic head pressure identical to when the static hydraulic head pressure of the column of production fluid is at a maximum volume, and wherein the powering means for powering the pump piston toward the discharge end results in raising the column of production fluid with the resultant discharge of a volume of production fluid into a discharge reservoir;

isolating means for isolating the powering means from the production fluid;

a pressure barrier to isolate the powering means from the production fluid and to restrain the stroke of the pumping piston;

resetting means to return the pump piston to a start position after a volume of the column of production fluid has been discharged to the reservoir at a controlled rate so as not to damage the pressure barrier of the pump piston;

entering and preventing means for allowing external production fluid into the pump body and into the column of production fluid and preventing the production fluid from flowing out when the pump piston is moved toward the discharge end; and wherein the static head of the column of production fluid is raised only once the length of the stroke of the pump piston and a volume of the production fluid is discharged from the top of the column of production fluid and the column of production fluid is returned without violent force to a point of beginning.

12. A pump according to claim 11, wherein:

the pump body encloses the discharge end and the pumping end such that the pump piston is horizontally displaced, with the pump body having a top surface from which vertically extends a pump piston production fluid output chamber and a stroke tube with stroke piston chamber, with the pump body having a bottom surface of rigid hollow tubular construction and, on the pumping end side of the pressure barrier, has a production fluid entry chamber and a supply tube which communicates therefrom to a pump piston ball check valve which controls flow of production fluid into the pump piston production fluid output chamber and on the discharge end has an hydraulic pre-charging cylinder.

13. A pump according to claim 12, wherein:

said entering and preventing means comprises a well screen extending from the bottom surface at the end opposite the hydraulic pre-charge cylinder, a production fluid entry tube through which production fluid flows into a production fluid entry chamber past a production fluid entry tube ball check valve of a diameter greater than that of the production fluid entry tube and vertically floatably restrained by a production fluid entry tube ball check valve retainer so that when the pressure of the fluid inside the production fluid entry chamber equals the pressure outside the production fluid entry tube, the production fluid entry ball check valve will fall against and block the production fluid entry tube, and a supply tube communicates from the production fluid entry chamber around the pump piston through a ball check valve which regulates the flow of production fluid, only, into the pump piston production fluid output chamber from the supply tube to the pump piston production output chamber so that said ball check valve closes when the pressure within the production fluid entry chamber equals the pressure in the pump piston production fluid output chamber.

14. A pump according to claim 12, wherein:

the pump piston is comprised of a solid shaft having a pre-charge plate, at the discharge end of the pump body abutting the hydraulic pre-charge cylinder, extending throughout the interior cross-section, and slidably communicating with the interior surface of the pump body by sealing means so that the pre-charge within the hydraulic pre-charge cylinder is maintained, which solid shaft slidably, via sealing means, penetrates a pump piston production fluid output chamber end barrier and said solid shaft extends through the pump piston production fluid output chamber which is limited in length by the discharge surface of a pump piston top fixed to the solid shaft and slidably communicating with the inner surface of the pump body by said sealing means and said solid shaft thence extending beyond the stroke tube and thence slidably through the pressure barrier, protected against by-pass of fluid by high pressure sealing means, and terminating at a pump piston base at the pumping end, which slidably engages the interior surface of the pump body by second sealing means and having a vent to outside the pump body below the production fluid level to eliminate cavitation, the vent located between the pump piston base and the pressure barrier.

15. A pump according to claim 11, wherein:

the pressure barrier comprises a collar of impervious rigid material extending inward from the pump body at a point along the horizontal span of the pump body by which the stroke piston chamber is separated from the production fluid entry chamber to communicate by high pressure sealing means with the solid shaft, so the solid shaft may move through the pressure barrier yet limit the movement of the solid shaft toward the discharge end by the mechanical interference with the pump piston base at the pumping end while the discharge face of the pump piston top is so located along the length of the solid shaft that it does not reach the stroke piston chamber when the pump piston is fully extended toward the production fluid entry chamber end and does not reach the pump piston production fluid output chamber when the pump piston is fully extended in the opposite direction.

16. A pump according to claim 12, wherein:

the powering means comprises a single stroke piston having an upper surface and a lower surface, the single stroke piston spanning the interior of the stroke piston chamber and movably communicating therewith by sealing means so as to establish the upper limit for a column of power fluid which communicates to the pumping face of the pump piston top and is driven against the column of power fluid so that the pressure within the column of power fluid exceeds the static pressure of the column of production fluid plus system friction and a pre-load force in the hydraulic pre-charge cylinder with the result that the pump piston moves toward the hydraulic pre-charge cylinder end, reducing the pressure in the production fluid entry chamber and closing the pump piston ball check valve and opening the fluid entry tube ball check valve while at the same time lifting the column of production fluid and discharging a portion of the production fluid from the top of the column of production fluid into a reservoir.

17. A pump according to claim 16, wherein:

the resetting means comprises the hydraulic pre-charge cylinder which has sufficient force to overcome the differential in static pressure between the column of power fluid, when the single stroke of the stroke piston is exhausted and the column of production fluid, reduced by the amount discharged into the reservoir when the pump piston reaches the limit of travel in the discharge direction, plus the system friction, force the pre-charge plate and the solid shaft, to which the pre-charge plate is attached, toward the production fluid entry chamber to the starting position, which closes the production fluid entry tube ball check valve and opens the pump piston ball check valve to refill the pump piston production fluid output chamber and column of production fluid.

18. A pump according to claim 16, wherein:

the stroke piston has a replenishment passage between the upper surface and the lower surface with the passage narrowing at the upper surface to a diameter less than the diameter of a replenishment ball check valve floatably maintained within the replenishment passage by a replenishment ball check valve retainer, so that power from a fluid chamber in the stroke piston chamber above the stroke piston can flow to recharge the column of power fluid should any power fluid by-pass the high pressure seals in the pressure barrier.

19. A single stroke hydraulic pump for raising production fluid against the force of gravity a substantial distance, comprising:

a pump body connected to a supply tube and fluid entry tube;

a powering means;

a pump piston comprised of a pump piston top and a pump piston base with the pump piston top being positioned on a pumping end of the pump body and the piston base being positioned on the discharge end of the pump body, the pump piston top and the pump piston base being connected by a solid shaft within the pump body, the pump body being completely submerged in the production fluid except for a top of a column of production fluid and the powering means;

a column of production fluid within the pump body stretching from a fluid output chamber on the discharge end of the pump body to a discharge reservoir above the surface of the production fluid in which the pump piston is submerged and having a static hydraulic head pressure;

a column of power fluid within the pump body and having an hydraulic head pressure identical to that of the static hydraulic head pressure of the column of production fluid when the column of production fluid is at a maximum volume, and wherein the powering means for powering the pump piston toward the discharge end is isolated from the production fluid and with the powering means providing power to raise the column of production fluid with a resultant discharge of a volume of production fluid into a discharge reservoir;

a pressure barrier is positioned between the pump piston top and pump piston base to isolate the powering means from the production fluid and to restrain the stroke of the pump piston;

resetting means to return the pump piston to a start position after a volume of the production fluid has been discharged to the reservoir at a controlled rate so as not to damage the pressure barrier;

entering and preventing means for allowing external production fluid into the pump body and into the column of production fluid and preventing the production fluid from flowing out when the pump piston is moved toward the discharge end; wherein the static head of the column of production fluid is raised only once the length of the stroke of the pump piston and a volume of production fluid is discharged from the top of the column of production fluid and the column of production fluid is returned without violent force to a point of beginning; and wherein the powering means is comprised of an hydraulic power cylinder having two ends and containing a pre-charge plate, the powering means being isolated from the production fluid by an end barrier through which the solid shaft slidably extends from the pre-charge plate, and having a pre-charge side on the end of the hydraulic power cylinder farthest away from the fluid output chamber, and having a pre-charge pressure therein of sufficient force to overcome the cumulative force of the column of power fluid plus internal system friction so that the pre-charge plate which is connected to the solid shaft moves toward a production fluid entry chamber that is connected to the pump body, thereby opening a pump piston ball check valve to allow production fluid in the supply tube to enter the output chamber, and after the volume of the column of production fluid is reduced by discharging into the reservoir, a power side of the hydraulic power cylinder which is separated from the pre-charge side by the pre-charge plate receives power from a remote driving means providing sufficient force to move the pre-charge plate so as to compress a precharge in the precharge side thereby moving the solid shaft and pump piston to close the pump piston ball check valve and force production fluid from the column of the production fluid into the reservoir.

* * * * *